US009504872B2

(12) United States Patent
Gittleson et al.

(10) Patent No.: US 9,504,872 B2
(45) Date of Patent: Nov. 29, 2016

(54) EXERCISE DEVICE

(71) Applicant: Rogers Athletic Company, Inc.

(72) Inventors: James Michael Gittleson, Ann Arbor, MI (US); Kenneth Edward Staten, Clare, MI (US); Tyler James Hobson, Montgomery, TX (US)

(73) Assignee: Rogers Athletic Company, Inc., Clare, MI (US)

( * ) Notice: Subject to any disclaimer, the term of this patent is extended or adjusted under 35 U.S.C. 154(b) by 0 days.

(21) Appl. No.: 14/271,510

(22) Filed: May 7, 2014

(65) Prior Publication Data

US 2014/0336004 A1 Nov. 13, 2014

Related U.S. Application Data

(60) Provisional application No. 61/820,220, filed on May 7, 2013.

(51) Int. Cl.

*A63B 23/025* (2006.01)
*A63B 21/06* (2006.01)
*A63B 23/03* (2006.01)

(52) U.S. Cl.

CPC ..... *A63B 23/025* (2013.01); *A63B 21/0615* (2013.01); *A63B 21/4003* (2015.10); *A63B 21/4039* (2015.10); *A63B 21/4047* (2015.10); *A63B 23/03* (2013.01); *A63B 2208/0233* (2013.01)

(58) Field of Classification Search

CPC ..... A63B 21/0615; A63B 21/1403; A63B 21/1407; A63B 21/1476; A63B 21/1492; A63B 21/1438; A63B 21/1442; A63B 21/08; A63B 21/1449; A63B 23/025; A63B 23/03; A63B 2021/0616; A63B 2021/0617; A63B 21/4047; A61H 1/0222; A61H 1/0229; A61H 1/0292; A61H 1/0296; A61H 2205/04; A61G 7/1013; A61G 7/1017; A61G 7/1019; A61G 7/1023

USPC ..... 482/10, 11, 93–103, 69, 43; 601/36, 38, 601/39; 602/32, 36, 38; 5/83.1, 9.1

See application file for complete search history.

(56) References Cited

U.S. PATENT DOCUMENTS 2,633,124 A * 3/1953 Yellin ..... 602/36
2,828,735 A * 4/1958 Thompson ..... A61H 1/0218 297/392
2,831,482 A * 4/1958 Cobb ..... A61H 1/0218 602/33
3,194,232 A * 7/1965 Rickenbach ..... A61H 1/0222 606/243
3,654,922 A * 4/1972 Outcalt ..... 602/36
4,372,553 A * 2/1983 Hatfield ..... 482/105
4,405,128 A * 9/1983 Mclaughlin ..... A63B 21/0615 482/137
4,407,274 A * 10/1983 Goodley ..... A61H 1/0218 606/241
4,508,109 A * 4/1985 Saunders ..... A61H 1/0218 602/33
4,545,575 A * 10/1985 Forjot ..... 482/69
4,582,320 A * 4/1986 Shaw ..... 482/130
4,682,377 A * 7/1987 Reich ..... A61G 7/1017 5/83.1
4,703,523 A * 11/1987 James ..... A61G 7/1017 5/83.1
4,844,456 A * 7/1989 Habing ..... A63B 21/06 482/100

(Continued)

*Primary Examiner* — Loan H Thanh
*Assistant Examiner* — Gregory Winter
(74) *Attorney, Agent, or Firm* — Carlson, Gaskey & Olds, P.C.

(57) ABSTRACT

An example exercise device includes an arm structure configured to pivot in response to a movement of at least a portion of a head of a user. An example method of exercising includes moving a portion of a head to pivot a weight arm that resists the moving.

14 Claims, 5 Drawing Sheets

(56) References Cited

U.S. PATENT DOCUMENTS 4,951,939 A * 8/1990 Peters ..... A63B 21/0615 482/94
4,961,574 A * 10/1990 Lew ..... A63B 69/0064 280/206
5,010,880 A * 4/1991 Lamb ..... A61H 1/0222 602/36
5,022,106 A * 6/1991 Richards ..... A61G 7/1017 4/254
5,554,084 A * 9/1996 Jones ..... A63B 21/0615 482/134
5,605,523 A * 2/1997 Ish et al. ..... 482/99
6,022,298 A * 2/2000 Svedarsky ..... A63B 21/0615 482/130
6,449,785 B1 * 9/2002 Liljedahl ..... A61G 7/1017 5/83.1
6,935,353 B2 * 8/2005 Hawkes ..... A61H 3/008 135/67
7,361,125 B2 * 4/2008 Webber ..... A63B 23/03525 482/130
8,057,368 B1 * 11/2011 Lyszczarz ..... 482/103
2002/0107117 A1 * 8/2002 Carter ..... A63B 21/0615 482/100
2005/0148445 A1 * 7/2005 Carle ..... A63B 21/0615 482/97
2007/0054787 A1 * 3/2007 Simmons ..... 482/97
2009/0312160 A1 * 12/2009 Higgins ..... 482/94
2010/0035729 A1 * 2/2010 Pandozy ..... 482/9
2012/0220428 A1 * 8/2012 Carlson ..... 482/8
2014/0274620 A1 * 9/2014 Hoole ..... A63B 23/1236 482/141
2016/0001118 A1 * 1/2016 Kuehne ..... A63B 69/0064 482/54

* cited by examiner

EXERCISE DEVICE

CROSS-REFERENCE TO RELATED APPLICATIONS

This application claims priority to U.S. Provisional Application No. 61820220, which was filed on 7 May 2013 and is incorporated herein by reference.

BACKGROUND

The present disclosure relates generally to equipment for exercising. More particularly, this disclosure relates to an exercise device for exercising a user's head, neck, and jaw.

Various exercises have been utilized to develop and train various areas of the body. Exercises have historically been performed with resistance provided by free weights, such as barbells or machines, or even using a user's body as resistance. Although various exercise devices exist, certain areas of the body remain difficult to exercising.

Examples of such areas include a user's head, neck, and jaw. Strengthening the head, neck, and jaw through exercises is particularly important for athletes involved in high impact sports, such as football. Strengthening these areas is also important for military personnel, which may face combat neck and, more basically, neck fatigue, during training and combat.

SUMMARY

An exercise device according to an exemplary aspect of the present disclosure includes, among other things, an arm structure configured to pivot in response to a movement of at least a portion of a head of a user.

In another example of the foregoing exercise device, the arm structure comprises a first bar and a second bar laterally spaced from the first bar.

In another example of any of the foregoing exercise devices, a strap is suspended from both a strap end of the first bar and a strap end of the second bar.

In another example of any of the foregoing exercise devices, the device further comprises a weight arm at a weight end of the first bar and a weight end of the second bar.

In another example of any of the foregoing exercise devices, the weight end of the first bar tapers toward the weight end of the second bar to meet the weight end of the second bar at the weight arm.

In another example of any of the foregoing exercise devices, the weight arm is pivotably attached to a support structure at a first location and a second location laterally spaced from the first location.

In another example of any of the foregoing exercise devices, the device further comprises a stand having a first upright to pivotably support the first bar and a second upright to pivotably support the second bar.

In another example of any of the foregoing exercise devices, the first and second uprights are laterally outside the first and second bars.

In another example of any of the foregoing exercise devices, the arm is configured to pivot in response to a downward movement of the head.

In another example of any of the foregoing exercise devices, the portion is a jaw that opens and closes to move the arm A method of exercising according to another exemplary aspect of the present disclosure includes, among other things, moving a portion of a head to pivot a weight arm that resists the moving.

In another example of the foregoing method, the portion is a jaw.

In another example of any of the foregoing methods, the moving comprises opening and closing a jaw.

In another example of any of the foregoing methods, the moving comprises lowering the portion of the head to lower a first end of the weight arm and raise an opposing, second end of the weight arm.

In another example of any of the foregoing methods, the method includes moving the portion of the head to pull downward the first end with a strap.

In another example of any of the foregoing methods, the method includes pivotably supporting laterally spaced bars of the weight arm using a pair of vertically extending upright positioned laterally outside the laterally spaced bars.

In another example of any of the foregoing methods, the method includes selectively supporting weight via a weight horn, the laterally spaced bars meeting at the weight horn.

In another example of any of the foregoing methods, the method includes moving the portion of the head against a strap, and suspending the strap from more than one point on the weight arm.

In another example of any of the foregoing methods, the moving comprises nodding.

In another example of any of the foregoing methods, the weight arm is pivotably attached to a support structure at a first location and a second location laterally spaced from the first location.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The various features and advantages of the disclosed examples will become apparent to those skilled in the art from the detailed description. The figures that accompany the detailed description can be briefly described as follows.

DETAILED DESCRIPTION

Figure 1:
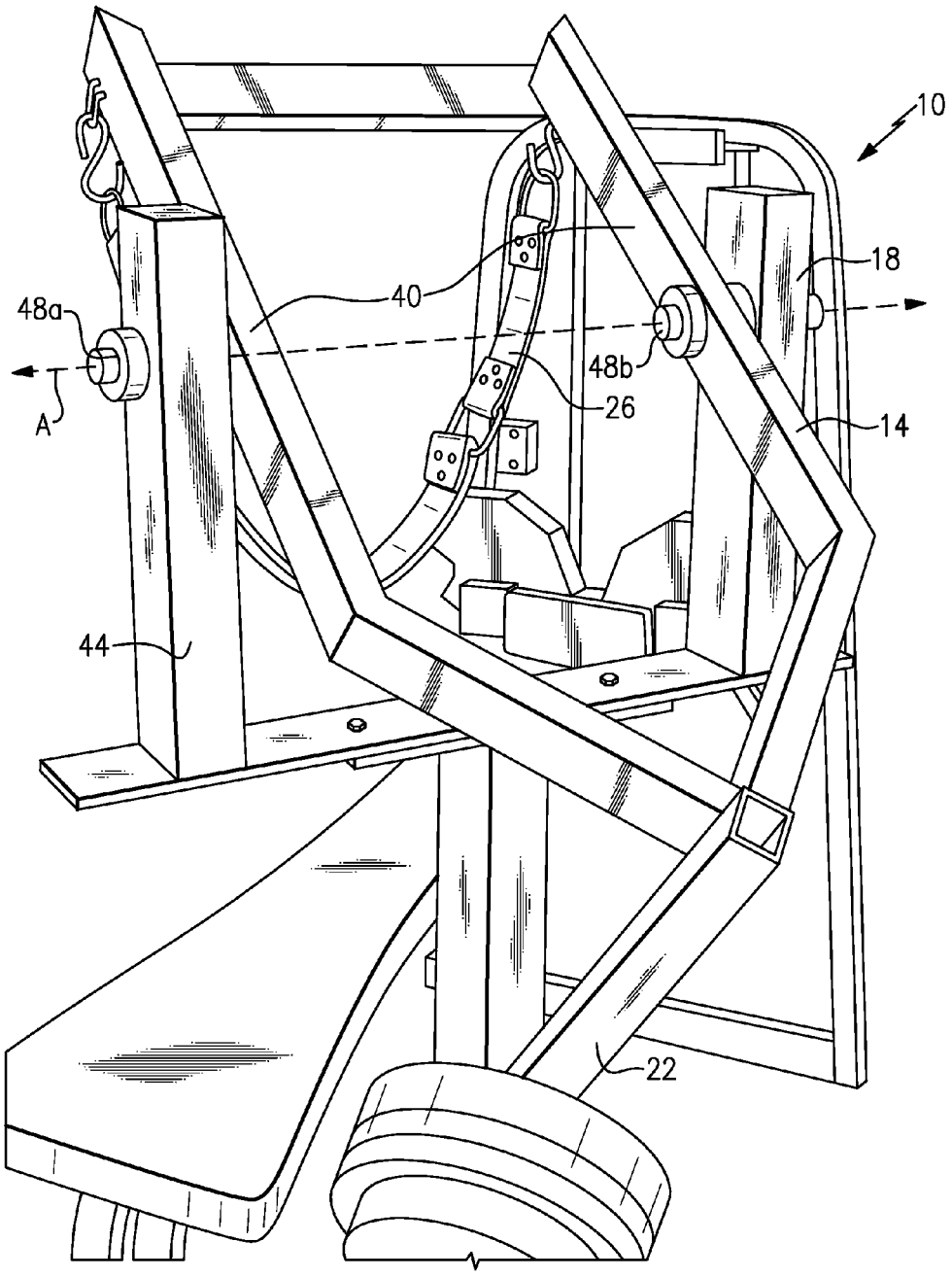
FIG. 1 shows a perspective view of an example exercise device.

An example device 10 is used to exercise at least a user's head, neck, and jaw. For purposes of this disclosure, the jaw is part of the user's head.

The example device 10 includes an arm structure 14 pivotably mounted to a stand 18. A weight arm 22 has a weight horn that extends from one end of the arm structure 14. A strap 26 is secured to another end of the arm structure 14. The example strap 26 hangs from the arm structure 14.

Exercise, in this disclosure, encompasses training, therapy, drills, calisthenics, and other pursuits requiring physical effort.

To operate the example exercise device 10, a user 30 positions their head such that their chin rests on the strap 26. The user 30 then moves their head and jaw, or just their jaw, to pivot the arm structure 14. The movement of the head is resisted by the strap 26. Free weights positioned on the weight arm 22 provide the resistance. Free weights may be added or removed depending on the amount of resistance desired. In some examples, no free weights are used and resistance is provided by some other mechanism, such as resistance bands 24 (FIG. 5).

When exercising, the user may make various movements to train the muscles and other areas of the head, neck, and jaw. Some of the movements, such as downward movements, may be resisted by the strap 26. In other movements, such as upward movements, the user may resist movement of the strap 26 to train. For example, the user 30 may resist the upward movement of the strap 26 after initially forcing the strap 26 downward using their head.

Movements possible to train with the exercise device 10 are typically specific movements that are difficult to replicate with other, more traditional, exercise devices.

Figure 2:
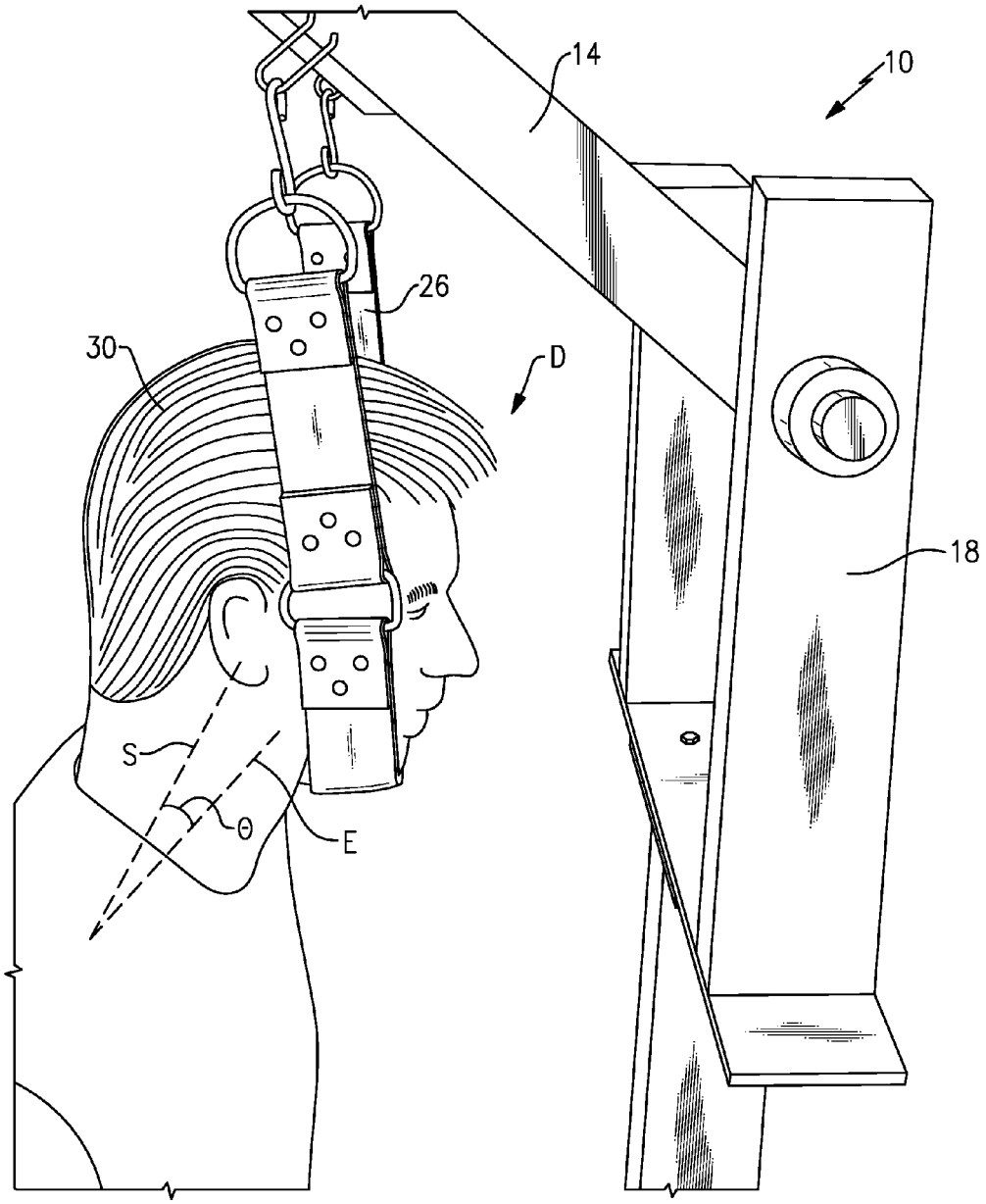
FIG. 2 shows a side view of a user engaging the exercise device of FIG. 1.
Figure 3:
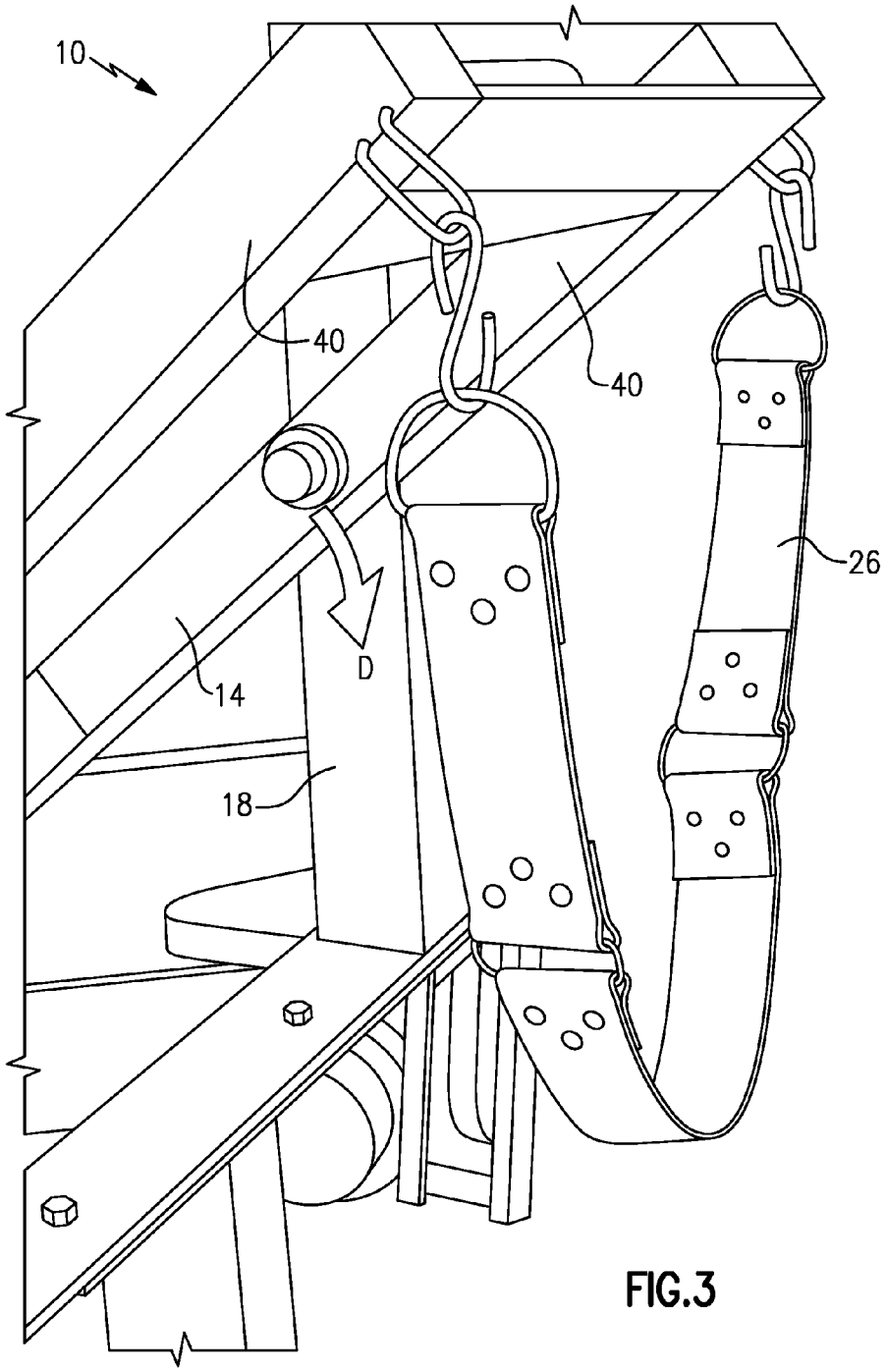
FIG. 3 shows a side view of a strap portion of the exercise device of FIG. 1.
Figure 4:
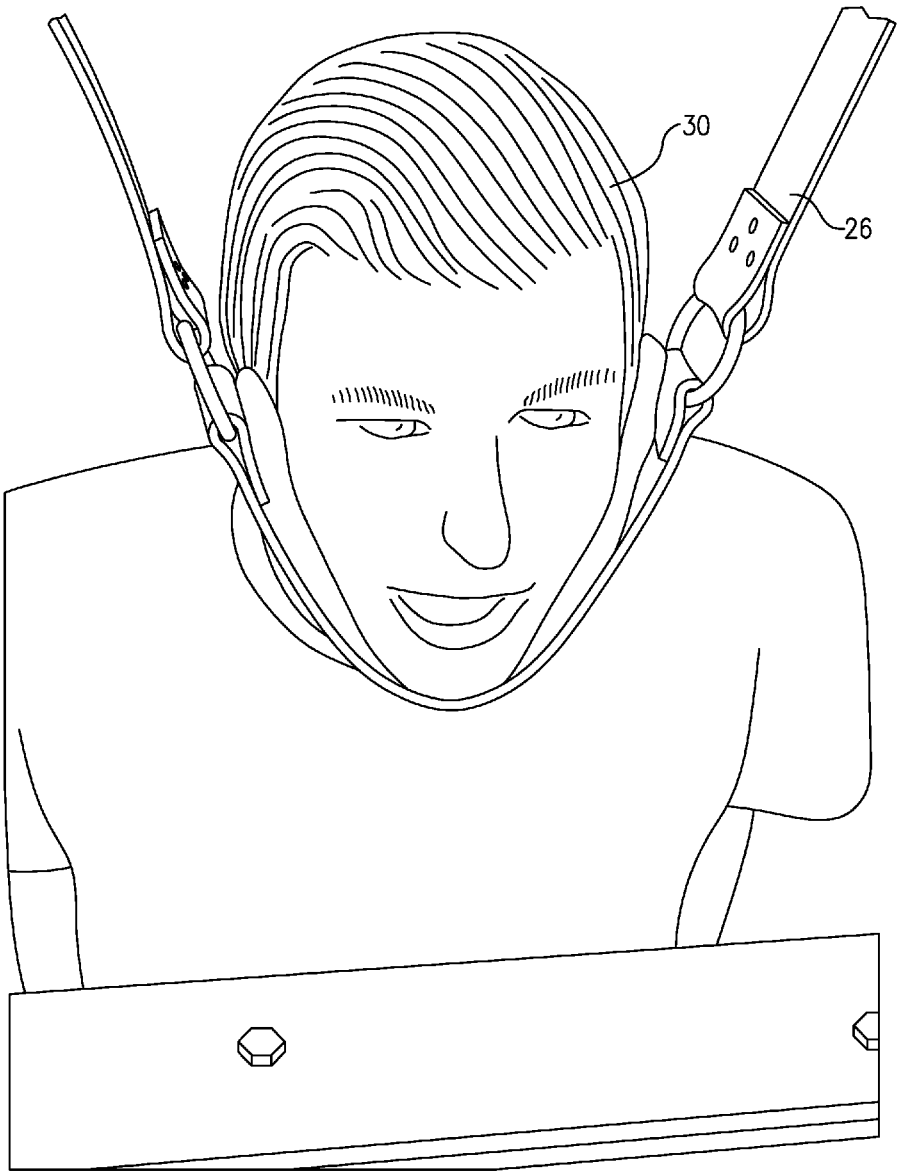
FIG. 4 shows a front view of the user engaging the exercise device of FIG. 1.
Figure 5:
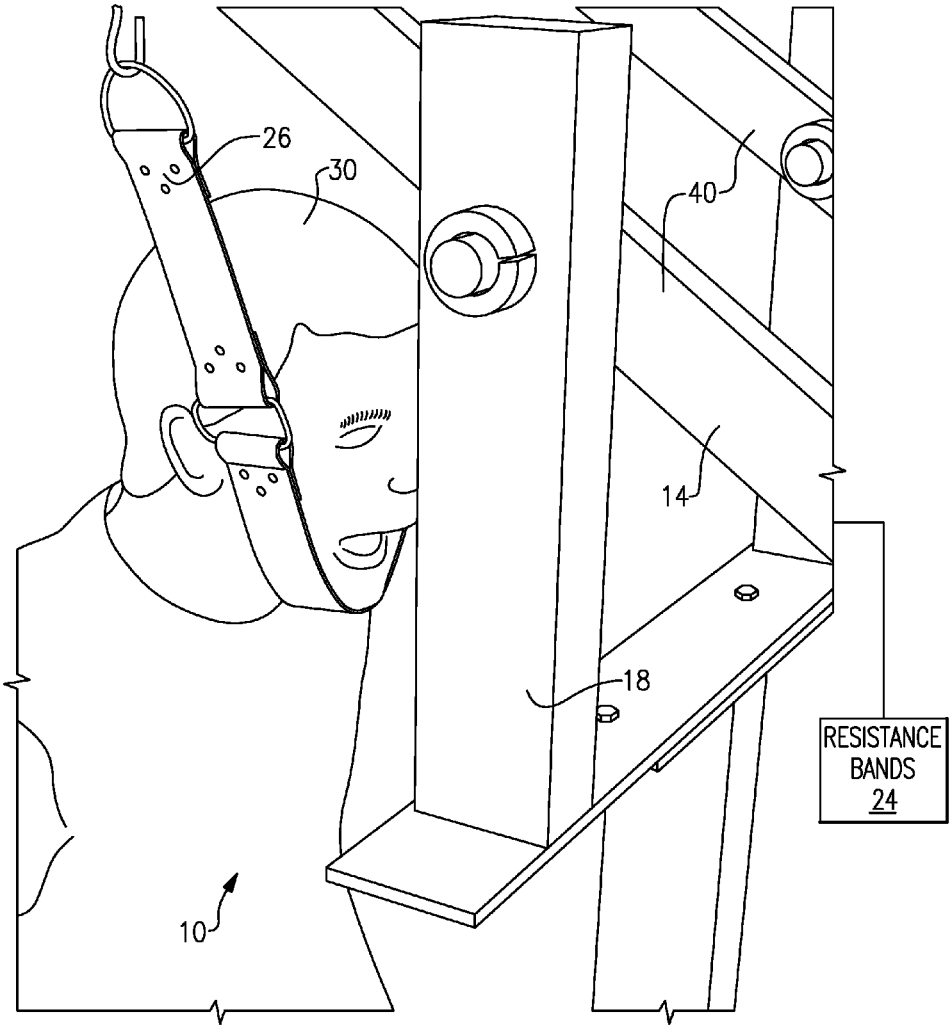
FIG. 5 shows a perspective view of the user engaging the exercise device of FIG. 1 and utilizing a resistance band instead of free weights.

One example exercise movement requires the user 30 to open their jaw from a position shown in FIG. 2 to the positions shown in FIGS. 4 and 5. The user 30 then closes their jaw back to the position shown in FIG. 2. The user 30 remains seated during this exercise movement. The top of the user's head remains relatively at the same vertical position, and same angle, when opening and closing their jaw. Opening the jaw forces the strap 26 downward. The opening of the jaw is resisted by the free weights on the weight arm 22 and the weight of the arm structure 14. Moving the strap 26 downward causes the arm structure 14 to pivot in a direction D. The user then closes their jaw while resisting the upward movement of the strap 26 and pivoting in a direction opposite the direction D.

Another example exercise movement requires the user 30, with a closed jaw, to nod their head forward from a start position S to an end position E (FIG. 2). In some examples, an angle θ from the start position to the end position is about 10 degrees. In another example, the angle θ is about 22 degrees. The specific amount of nodding can be adjusted to other angles depending on the desired exercise movement. The forward nodding causes the strap 26 to move downward and pivots the arm structure 14 in the direction D. The forward nod is resisted by the free weights on the weight arm 22 and the weight of the arm structure 14. The user 30 resists the tendency of the weight arm 22 to try to pivot back a rest position where the head has not nodded.

In another example, the user 30 nods their head with their jaw open rather than closed.

Other exercises are possible, including exercises involving side to side (or lateral) movements of the head, backward movements of the head, etc.

In this example, the user 30 remains seated on a bench seat that is adjustable, such that the user 30 is able to comfortably rest their chin in the strap 26 without encountering significant resistance.

In addition to the adjustments provided by the bench seat, the strap 26 may have an adjustable height and position, such that the area that receives the chin can be vertically adjusted, laterally adjusted, or both relative to the respective end of the arm structure 14.

In this example, the strap 26 is a padded leather strap that is connected at opposite ends to spaced bars 40 of the arm structure 14. Other example straps may include plastic or nylon straps. Other examples straps may be suspended at one point from the arm structure 14, or at more than two points from the arm structure 14.

The spaced bars 40 are generally parallel in this example, although other alignments are possible. A u-shaped structure 44 of the stand 18 supports the spaced bars through pivots 48*a* and 48*b*.

The arm structure 14 pivots about a single axis A in this example. Other examples may include pivoting the arm structure 14 about more than one axis. The axis A extends through uprights of the u-shaped structure 44.

The arm structure 14 includes the spaced bars 40. Bars of the arm structure 14 at ends opposite the strap 26 are angled and meet at the weight arm 22 from which the weight horn extends.

In some examples, the arm structure 14 or another area of the exercise device 10 may include a handle or arm that user grasps during or when exercising. The user may use the handle or arm to assist in overcoming the resistance of the arm structure 14 and weights, such as when the handle extends from the end of the arm structure 14 having the strap 26. In another example, the handle is simply a mechanism to stabilize the user when exercising.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

The invention claimed is:

1. An exercise device, comprising:

an arm structure configured to pivot in response to a movement of at least a portion of a head of a user;

a first bar of the arm structure;

a second bar of the arm structure laterally spaced from the first bar, wherein the first bar and the second bar each include a weight end that resists pivoting of the arm structure, wherein the first bar is pivotably attached to a support structure at a first location and the second bar is pivotably attached to the support structure at a second location laterally spaced from the first location;

a common strap assembly suspended from a strap end of the first bar and a strap end of the second bar; and a common weight arm at the weight end of the first bar and the weight end of the second bar, wherein the weight end of the first bar converges toward the weight end of the second bar to meet the weight end of the second bar at the common weight arm, wherein the common weight arm is configured to receive a resistance mechanism.

2. The exercise device of claim 1, further comprising a stand having a first upright to pivotably support the first bar and a second upright to pivotably support the second bar.

3. The exercise device of claim 2, wherein the first and second uprights are laterally outside the first and second bars.

4. The exercise device of claim 1, wherein the arm structure is configured to pivot in response to a downward movement of the head, wherein the first and second locations are positioned between the strap end and the weight end such that downward movement of the strap end causes upward movement of the weight end.

5. The exercise device of claim 1, wherein the portion is a jaw that opens and closes to move the arm structure.

6. The exercise device of claim 1, wherein the first and second locations are positioned between the strap end and the common weight arm such that downward movement of the strap end causes upward movement of the common weight arm.

7. The exercise device of claim 1, further comprising resistance bands to resist movement of the arm structure.

8. The exercise device of claim 1, wherein the first arm and the second arm are configured to pivot about a common pivot axis in a first pivoting direction where the strap end moves downward and the weight end moves upward, and in an opposite, second pivoting direction where the strap end moves upward and the weight end moves downward.

9. An exercise device, comprising:

an arm structure configured to pivot in response to a movement of at least a portion of a head of a user;

a first bar of the arm structure;

a second bar of the arm structure laterally spaced from the first bar; and a common strap assembly suspended from a strap end of the first bar and a strap end of the second bar, wherein the first bar is pivotably attached to a support structure at a first location, and the second bar is pivotably attached to the support structure at a second location laterally spaced from the first location, wherein pivoting movements of the first bar and the second bar relative to the support structure are resisted by a weight end secured to the first bar and a weight end secured to the second bar, wherein the weight end of the first bar converges toward the weight end of the second bar to meet the weight end of the second bar at a weight arm, wherein the weight arm is configured to receive a resistance mechanism.

10. The exercise device of claim 9, wherein the first and second locations are positioned between the strap end and the weight end such that downward movement of the strap end causes upward movement of the weight end.

11. The exercise device of claim 10, wherein the first and second locations are positioned between the strap end and the weight arm such that downward movement of the strap end causes upward movement of the common weight arm.

12. The exercise device of claim 9, wherein the first arm and the second arm are configured to pivot about a common pivot axis in a first pivoting direction where the strap end moves downward and the weight end moves upward, and in an opposite, second pivoting direction where the strap end moves upward and the weight end moves downward.

13. The exercise device of claim 9, further comprising a stand having a first upright to pivotably support the first bar and a second upright to pivotably support the second bar.

14. The exercise device of claim 1, wherein the weight end is configured to pivot about the first location and the second location when the arm structure is pivoted.

* * * * *